US012613075B2

(12) United States Patent
Blosser

(10) Patent No.: US 12,613,075 B2
(45) Date of Patent: Apr. 28, 2026

(54) CABLE ADJUSTMENT ASSEMBLY FOR COMPOUND BOW

(71) Applicant: Darton Archery LLC, Canton, GA (US)

(72) Inventor: Benjamin D. Blosser, Corydon, KY (US)

(73) Assignee: Darton Archery LLC, Canton, GA (US)

( * ) Notice: Subject to any disclaimer, the term of this patent is extended or adjusted under 35 U.S.C. 154(b) by 0 days.

(21) Appl. No.: 19/280,642

(22) Filed: Jul. 25, 2025

(65) Prior Publication Data

US 2026/0016259 A1 Jan. 15, 2026

Related U.S. Application Data

(63) Continuation-in-part of application No. 18/906,632, filed on Oct. 4, 2024.

(60) Provisional application No. 63/656,674, filed on Jun. 6, 2024.

(51) Int. Cl.
*F41B 5/10* (2006.01)
*F41B 5/14* (2006.01)

(52) U.S. Cl.
CPC ..... *F41B 5/1411* (2013.01); *F41B 5/10* (2013.01)

(58) Field of Classification Search
CPC ..... F41B 5/1411; F41B 5/10; F41B 5/105; F16B 7/06; F16B 7/105; F16B 7/1472; F16B 39/08; F16G 11/12
USPC ..... 124/86
See application file for complete search history.

(56) References Cited

U.S. PATENT DOCUMENTS

| | | | | |
|---|---|---|---|---|
| 291,903 A | | 1/1884 | Hill | |
| 3,802,411 A | | 4/1974 | Manspeaker | |
| 3,923,035 A | | 12/1975 | Trotter | |
| 4,005,696 A | | 2/1977 | Jennings | |
| 4,440,142 A | * | 4/1984 | Simonds | F41B 5/10 124/90 |

(Continued)

FOREIGN PATENT DOCUMENTS

CN 116447919 A 7/2023

OTHER PUBLICATIONS

Amazon, "Pulley with riveted retaining bracket and eyelet screw . . . ", https://www.amazon.de/-/en/riveted-retaining-bracket-diameter-diameter/dp/B087BSZ7LG#:~:text=Pulley%20with%20riveted%20retaining%20bracket%20and%20eyelet%20screw%20(M8), downloaded Oct. 3, 2024.

(Continued)

*Primary Examiner* — John E Simms, Jr.
(74) *Attorney, Agent, or Firm* — Brooks Kushman P.C.

(57) ABSTRACT

A compound bow includes a cable assembly including an adjustment assembly. The adjustment assembly has a first unit and a second unit on a rotational axis of the cable assembly. A first cable segment has a terminal end rotationally fixed to the first unit. A second cable segment has a terminal end rotationally fixed to the second unit. The adjustment assembly includes a lock between the first unit and the second unit. The lock is movable between a locked position and an unlocked position. The first unit and the second unit are rotatable relative to each other about the rotational axis R of the adjustment assembly when the lock is in the unlocked position. The first unit and the second unit are fixed relative to each other about the rotational axis of the adjustment assembly when the lock is in the locked position.

20 Claims, 16 Drawing Sheets

(56) References Cited

U.S. PATENT DOCUMENTS

| | | | | |
|---|---|---|---|---|
| 4,448,183 | A | 5/1984 | Quartino et al. | |
| 4,570,606 | A | 2/1986 | Peck | |
| 4,594,018 | A * | 6/1986 | Larsson | F16G 11/12 403/46 |
| 4,612,906 | A | 9/1986 | Troncoso | |
| 4,646,708 | A | 3/1987 | Imes | |
| 4,733,648 | A | 3/1988 | Martin | |
| 4,781,167 | A * | 11/1988 | Martin | F41B 5/10 124/90 |
| 4,909,231 | A | 3/1990 | Larson | |
| 4,993,399 | A | 2/1991 | Chattin | |
| 5,211,155 | A | 5/1993 | Zamojski | |
| 5,381,777 | A | 1/1995 | Mitchell et al. | |
| 5,390,655 | A | 2/1995 | Mitchell et al. | |
| 5,499,618 | A | 3/1996 | Thompson | |
| 5,606,963 | A * | 3/1997 | Wenzel | F41B 5/10 124/25.6 |
| 5,697,355 | A | 12/1997 | Schaffer | |
| 5,809,984 | A * | 9/1998 | Johnson | F41B 5/105 124/25.6 |
| 5,906,450 | A * | 5/1999 | Ng | F16G 11/12 403/22 |
| 7,637,256 | B2 | 12/2009 | Lee | |
| 7,669,501 | B2 * | 3/2010 | Rothe | F16C 1/226 188/196 R |
| 8,028,685 | B2 | 10/2011 | Clark | |
| 8,205,607 | B1 * | 6/2012 | Darlington | F41B 5/105 124/90 |
| 8,220,446 | B2 | 7/2012 | Batdorf | |
| 8,534,269 | B2 | 9/2013 | Wilson et al. | |
| 9,038,618 | B1 | 5/2015 | Bomar | |
| 10,267,589 | B1 | 4/2019 | Snook | |
| 10,359,252 | B2 * | 7/2019 | Ady | F41B 5/1403 |
| 11,566,864 | B2 | 1/2023 | Nevels et al. | |
| 11,573,062 | B2 | 2/2023 | Haas et al. | |
| 2007/0193568 | A1 * | 8/2007 | Lee | F41B 5/105 124/25.6 |
| 2011/0192385 | A1 * | 8/2011 | Clark | F41B 5/10 124/88 |
| 2015/0090196 | A1 | 4/2015 | Fleming et al. | |
| 2015/0184974 | A1 | 7/2015 | Blahnik | |
| 2017/0370673 | A1 * | 12/2017 | Yehle | F41B 5/10 |
| 2022/0106973 | A1 * | 4/2022 | Baehr | F16B 39/08 |
| 2024/0085140 | A1 * | 3/2024 | Hyde | F41B 5/1403 |
| 2024/0230071 | A1 * | 7/2024 | Bley | F21V 21/38 |

OTHER PUBLICATIONS

Bogensportshop, PSE Yoke-Splitter PBTS (s Stk.), https://bogensportshop.eu/en/compound/parts/other-parts/pse-yoke-splitter-pbts-replacement-part.html#:~:text=Yoke%20Splitter%20from%20PSE.%20PSE%20calls%20it%20PBTS%20(Precision%20Buss, downloaded Oct. 3, 2024.

Darton Archery, "Prelude E 32", https://dartonarchery.com/prelude-e-32#:~:text=The%20ALL%20new%20Prelude%20E%2032%20was%20designed%20from%20the, downloaded Oct. 3, 2024.

The Home Depot, "Everbilt 1-inch Light-Duty Single-Sheave Swivel-Eye Pulley . . . ", https://www.homedepot.ca/product/everbilt-1-inch-light-duty-single-sheave-swivel-eye-pulley-for-max-1-4-inch-rope-88-lb-safe-working-load/1001026185, downloaded Oct. 3, 2024.

Shop Atlas, "Bows Matthews Archery", https://www.mathewsinc.com/product/atlas/#:~:text=Custom-built%20with%20long-draw%20archers%20in%20mind,%20the%20ATLAS, downloaded Oct. 3, 2024.

Ubuy, "Heavy Duty Stainless Steel Pulley Set with Ropo and India", https://www.ubuy.cl/sp/productuk/FB45Z5CBK-tootaci-pulley-set-34mm-u-type-pulley-block-set-stainless-steel-pulley-system-with-rope-and-hook-2pcs-swivel-pulley-wheel-20m-6mm-nylon-rope-4pcs-snap, downloaded Oct. 3, 2024.

Topoint Archery, "Topoint X 40 Target Compound Bow, Axle-Axle 40", Draw [Weright] Weight 50-50LB/50-60LB, Draw Length 27-31", https://topont-shop.com/products/topoint-x40.

* cited by examiner

CABLE ADJUSTMENT ASSEMBLY FOR COMPOUND BOW

CROSS-REFERENCE TO RELATED APPLICATIONS

The subject patent application is a continuation-in-part of U.S. patent application Ser. No. 18/906,632 filed on Oct. 4, 2024, which claims priority to and all the benefits of U.S. Provisional Patent Application 63/656,674 filed on Jun. 6, 2024, both of which are herein incorporated by reference in their entirety.

BACKGROUND

A compound bow includes a riser and a first limb and a second limb each supported by the riser. The compound bow includes cams that are rotatably connected to the limbs. A bow string and at least one cable extend between the cams and typically has two cables extending between the cams. Specifically, the cam has at least one track engaged with the cable and/or a bow string and at least one of the tracks is eccentric relative to the rotational axis of the cam. By drawing the bow string from a brace position to the drawn position, the bow string rotates the cams to draw in the cables and resiliently flex the limbs toward each other.

Performance of the cams of the compound bow is dependent on the relative timing of the two cams when the bow string is drawn to the drawn position. When the timing of the two cams is synchronized, the cable is taken up on the cams, e.g., the cammed tracks of the cams, according to manufacturer design. Optimal performance of the compound bow results when timing of the rotation of the two cams is synchronized when the bow string is drawn, and performance of the compound bow is degraded when the timing of the two cams is not synchronized.

DETAILED DESCRIPTION

Figure 1:
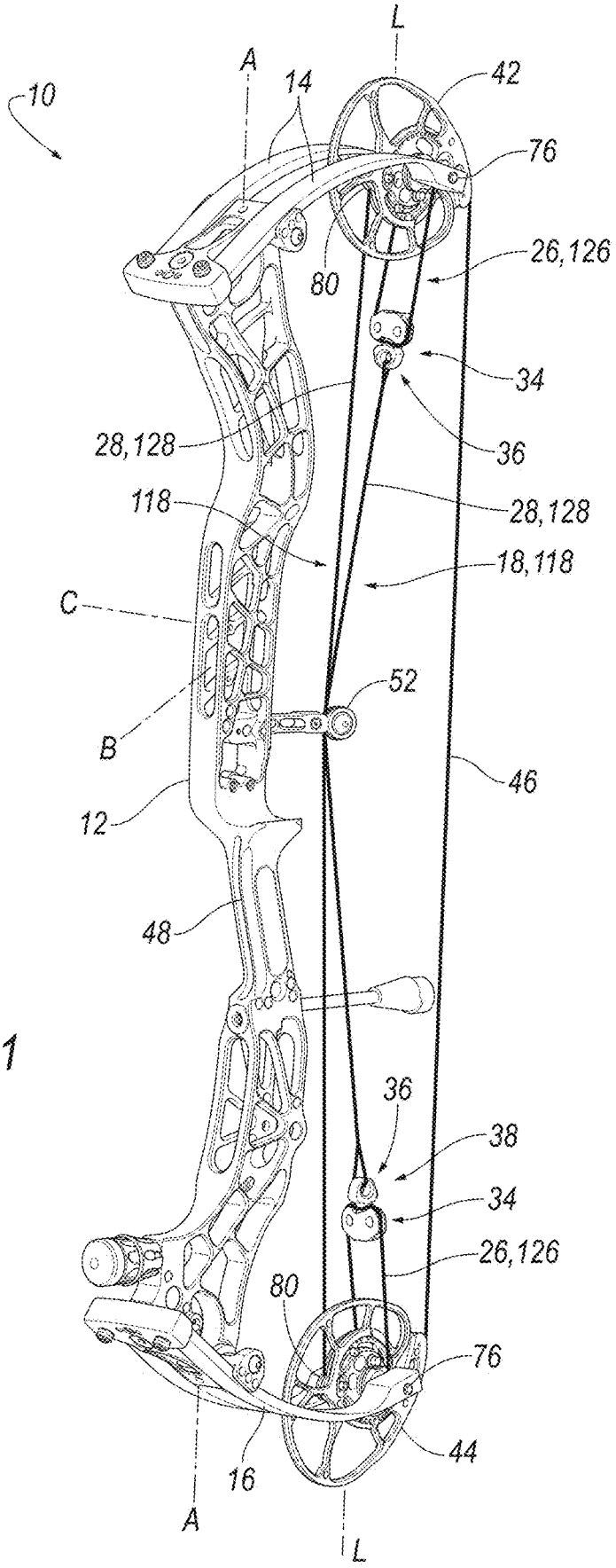
FIG. 1 is a perspective view of an example compound bow including two cables each including an example adjustment assembly.

With reference to the Figures, wherein like numerals indicate like parts throughout the several views, a compound bow 10 includes a riser 12. A first limb 14 and a second limb 16 are each supported by the riser 12. A cable assembly 18 connects the first limb 14 and the second limb 16 along a longitudinal axis L of the cable assembly 18. The cable assembly 18 includes an adjustment assembly 20 having a first unit 22 and a second unit 24 on a rotational axis R of the cable assembly 18. The cable assembly 18 includes a first cable segment 26 having a terminal end 34 rotationally fixed to the first unit 22. The first cable segment 26 extends from the first unit 22 toward the first limb 14. The cable assembly 18 includes a second cable segment 28 having a terminal end 36 rotationally fixed to the second unit 24. The second cable segment 28 extends from the second unit 24 toward the second limb 16. The adjustment assembly 20 includes a lock 32 between the first unit 22 and the second unit 24. The lock 32 is movable between a locked position and an unlocked position. The first unit 22 and the second unit 24 are rotatable relative to each other about the rotational axis R of the adjustment assembly 20 when the lock 32 is in the unlocked position. The first unit 22 and the second unit 24 are fixed relative to each other about the rotational axis R of the adjustment assembly 20 when the lock 32 is in the locked position.

Figure 8:
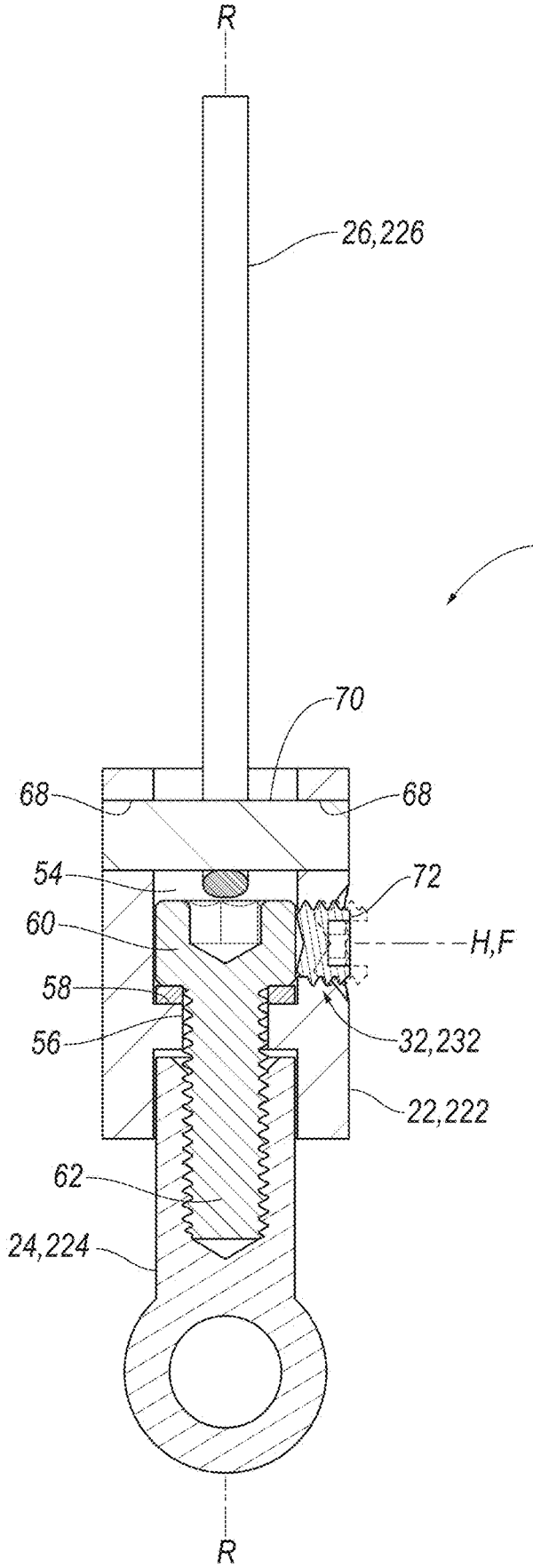
FIG. 8 is a cross-sectional view of the adjustment assembly of FIG. 5.
Figure 9:
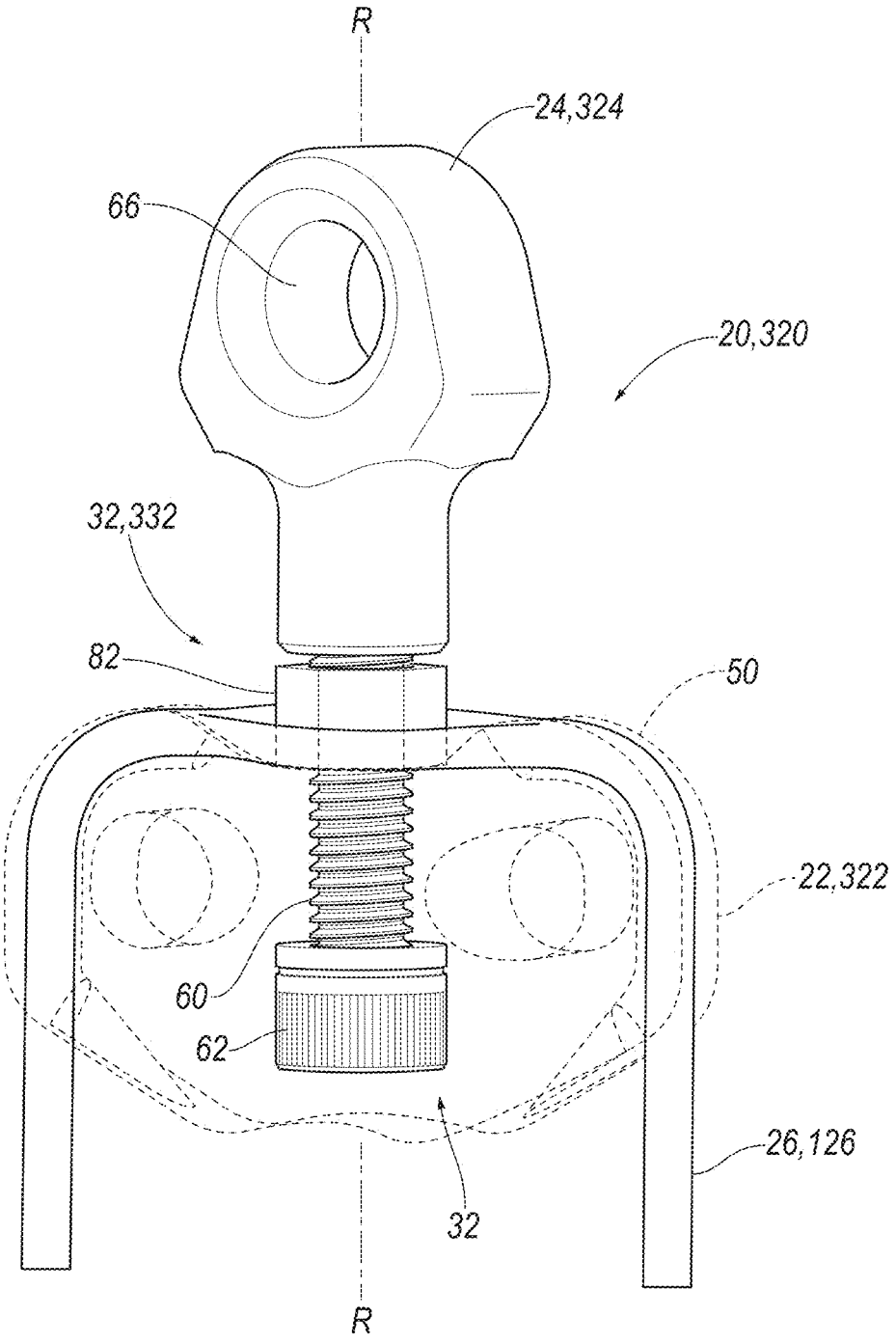
FIG. 9 is a perspective view of another example adjustment assembly.
Figure 10:
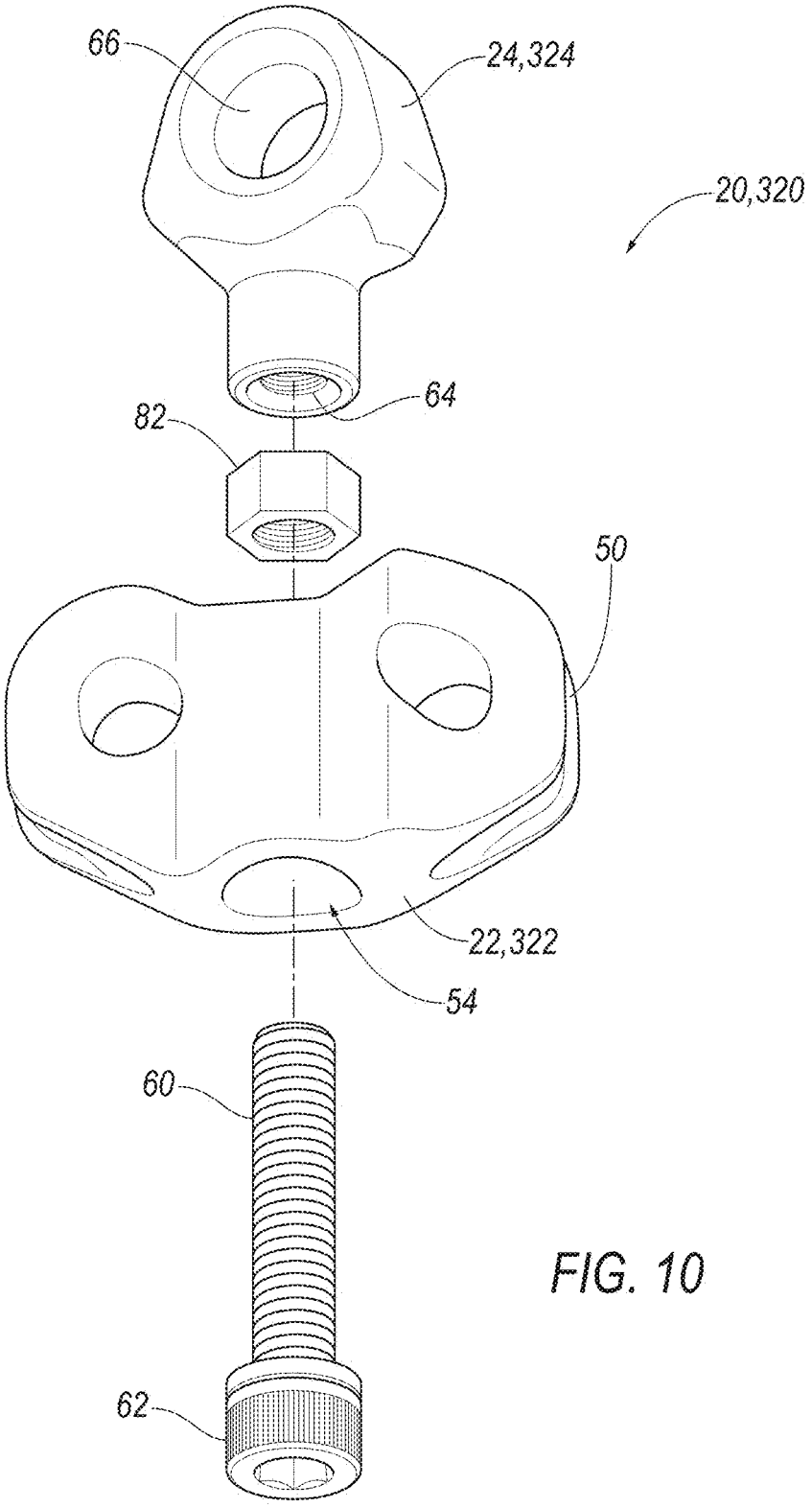
FIG. 10 is an exploded view of the adjustment assembly of FIG. 9.
Figure 11:
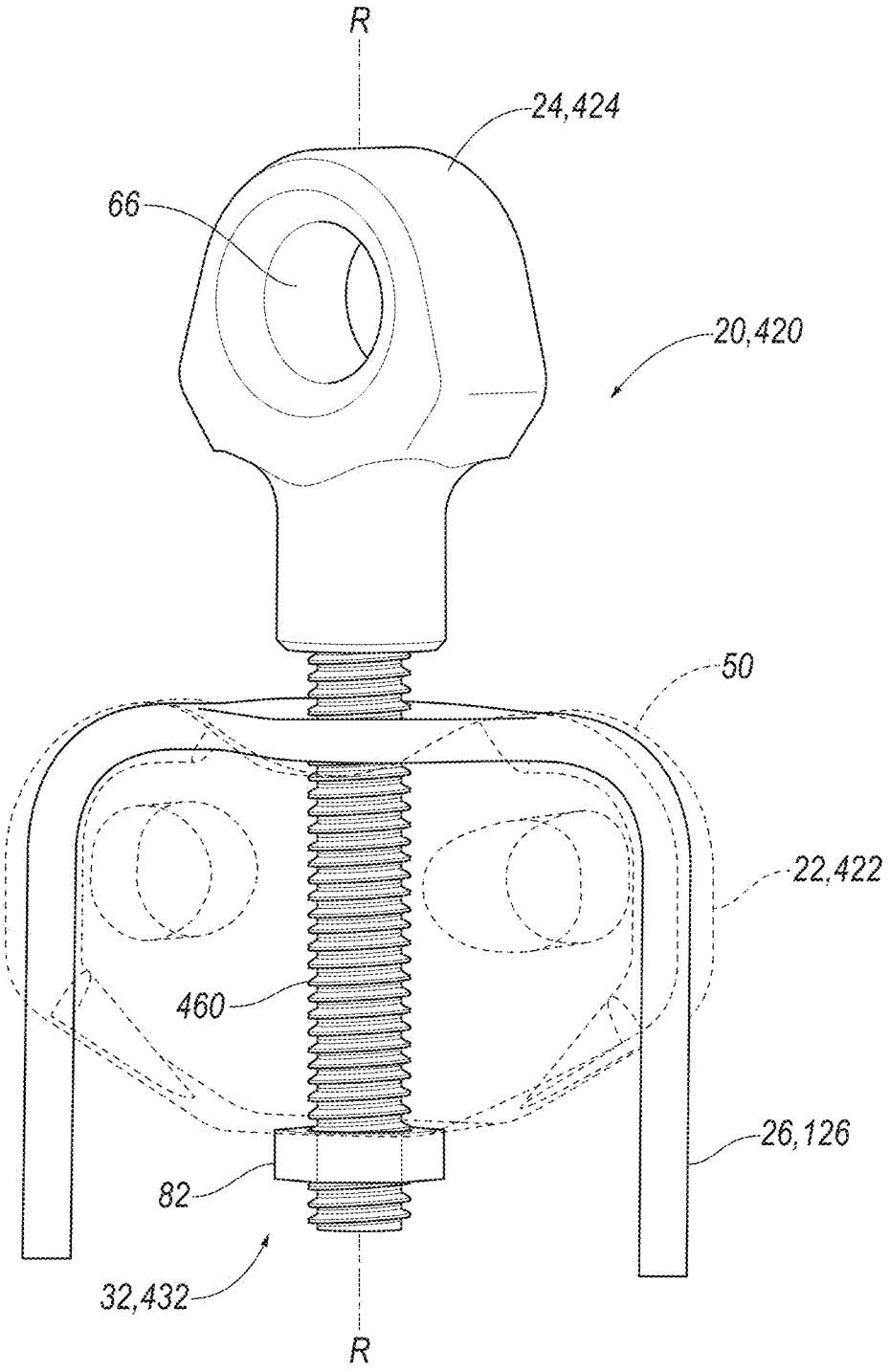
FIG. 11 is a perspective view of another example adjustment assembly.
Figure 12:
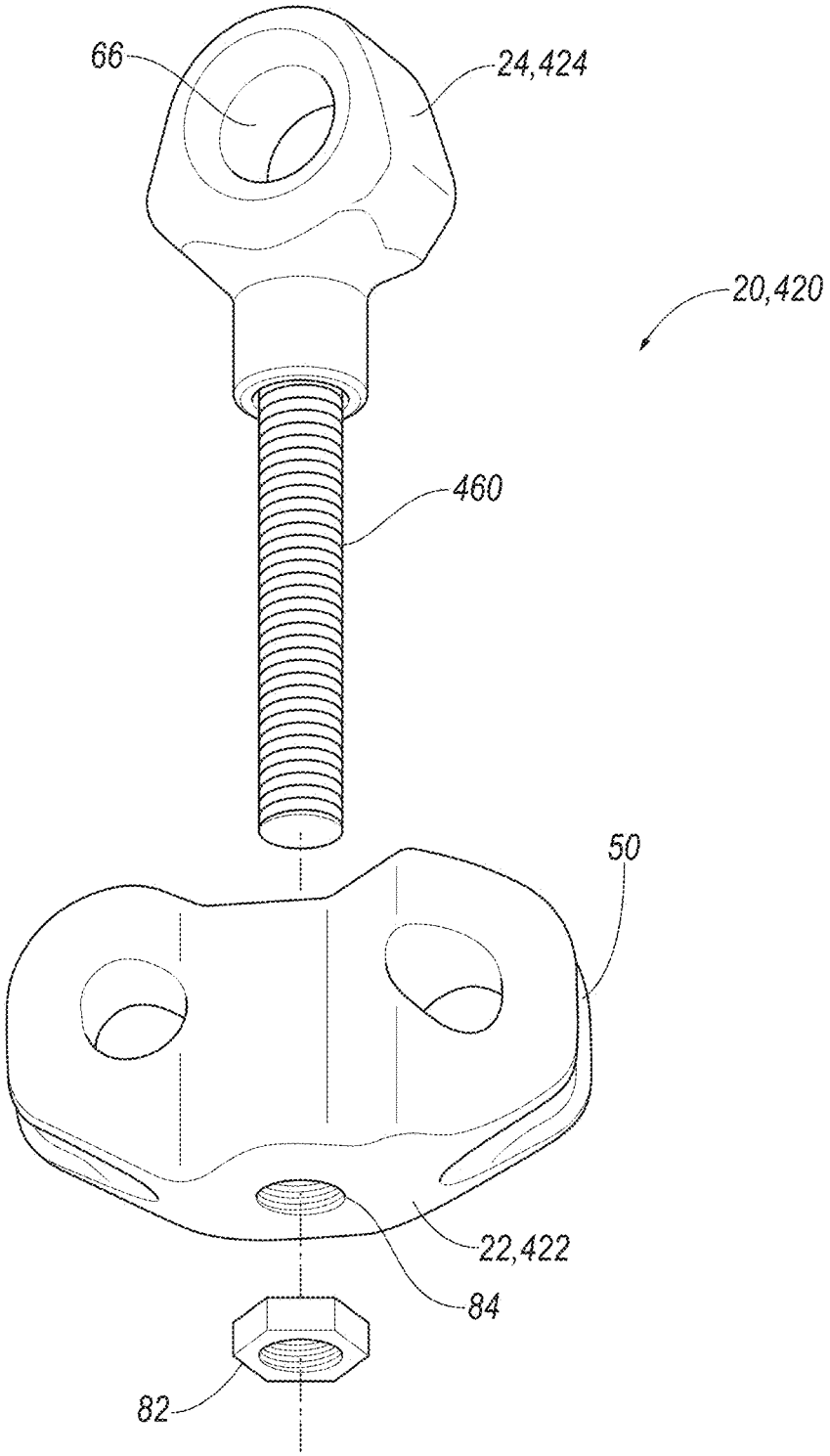
FIG. 12 is an exploded view of the adjustment assembly of FIG. 11.
Figure 13:
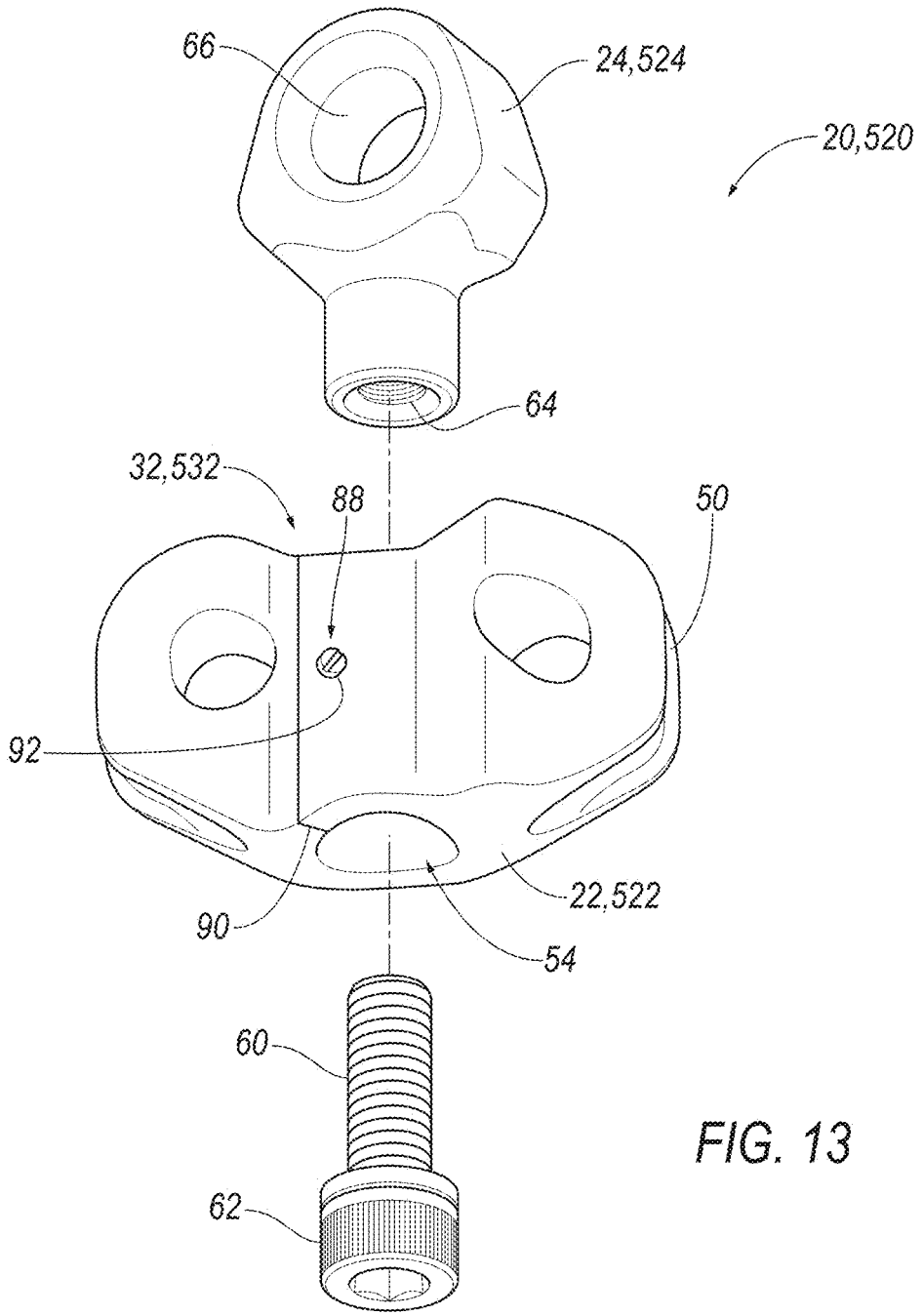
FIG. 13 is an exploded view of another example adjustment assembly.
Figure 14:
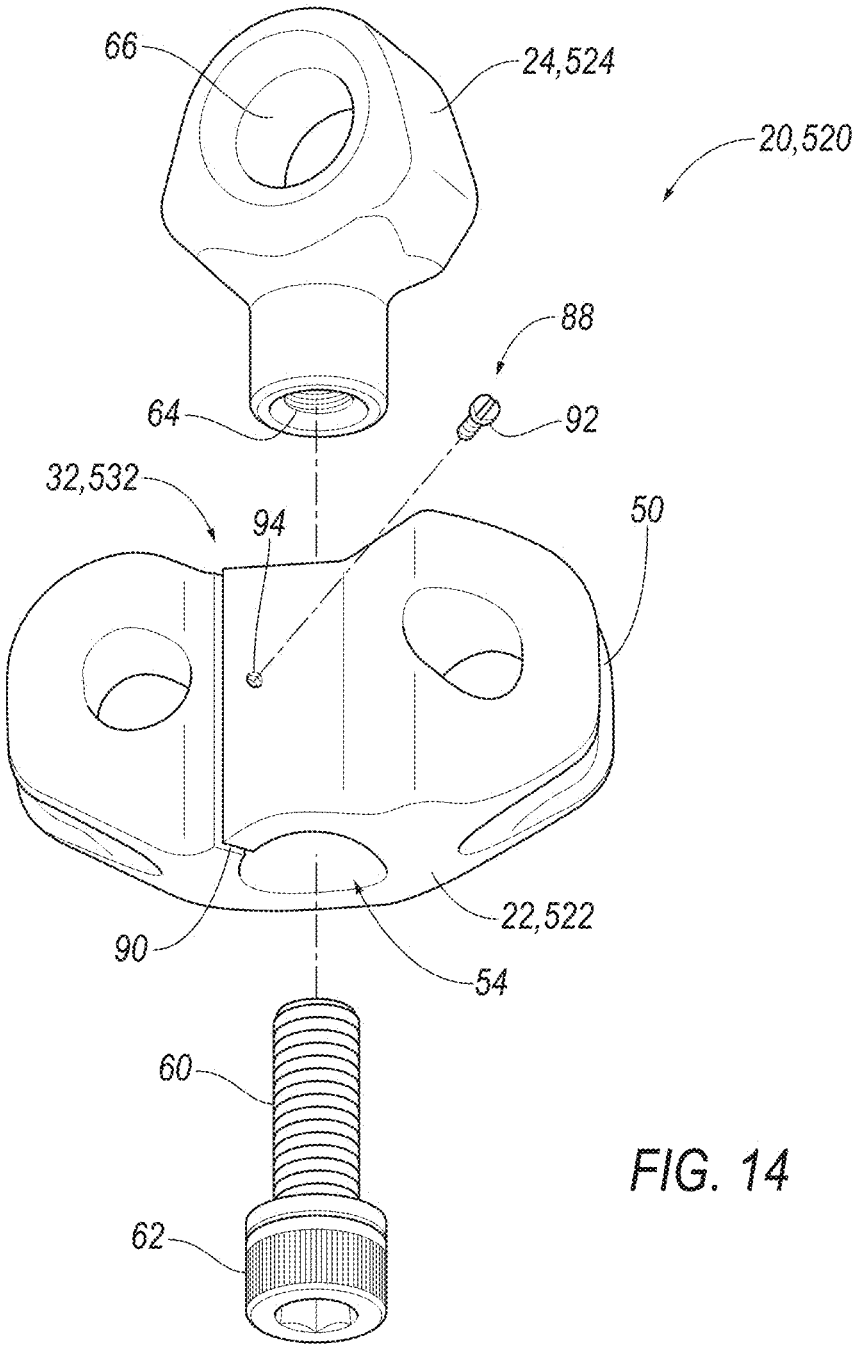
FIG. 14 is another exploded view of the adjustment assembly of FIG. 13.
Figure 15:
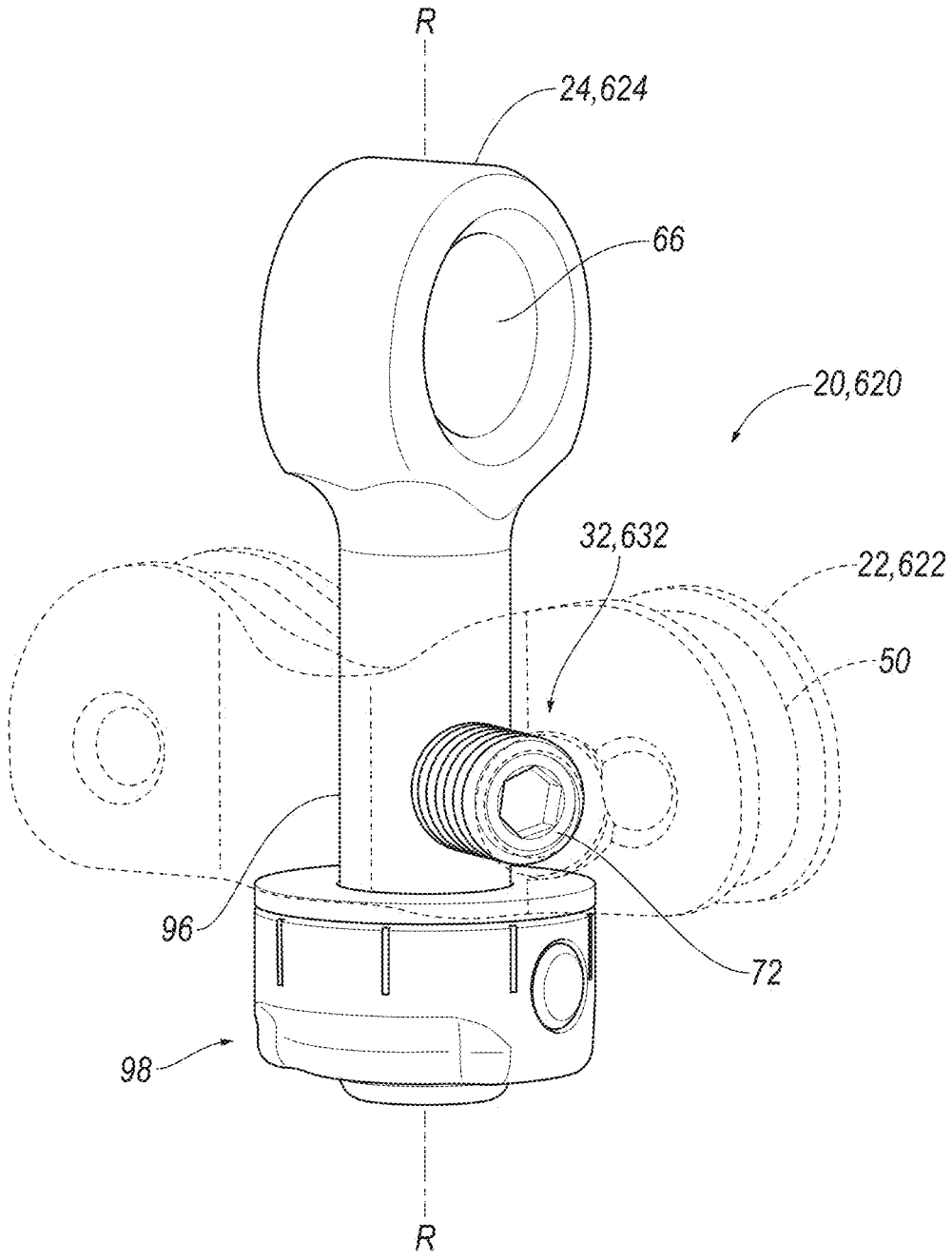
FIG. 15 is a perspective view of another example adjustment assembly.
Figure 16:
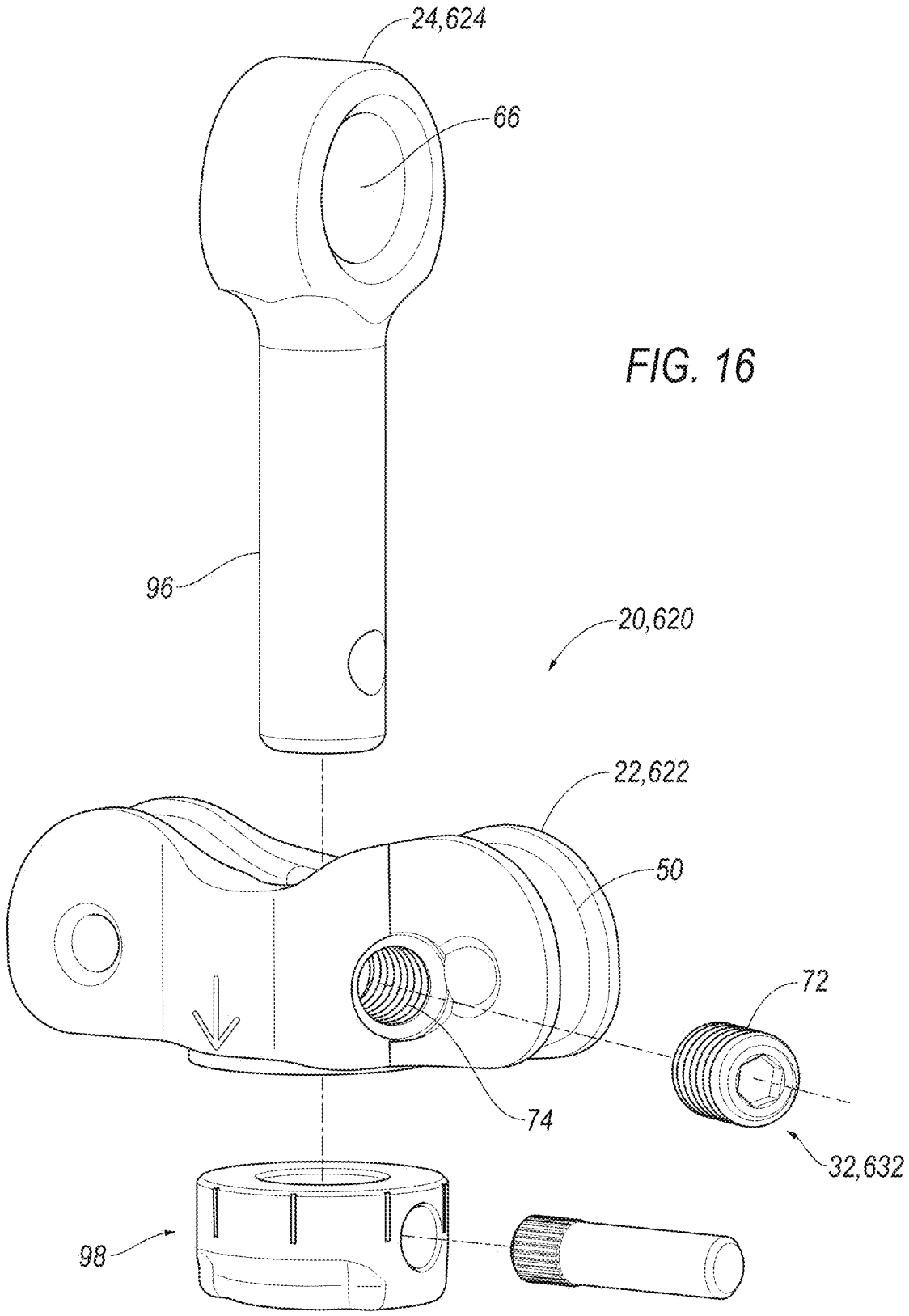
FIG. 16 is an exploded view of the adjustment assembly of FIG. 15.

A first example of the cable assembly 18 is shown in FIGS. 1-4 and is labeled with reference numeral 118; a second example of the cable assembly 18 is shown in FIGS. 5-8 and is labeled with reference numeral 218; components of a third example of the cable assembly 18 are shown in FIGS. 9-10; components of a fourth example of the cable assembly 18 are shown in FIGS. 11-12; components of a fifth example of the cable assembly 18 are shown in FIGS. 13-14; and components of a sixth example of the cable assembly 18 are shown in FIGS. 15-16. Elements having common element names in the examples in the Figures are identified with reference numerals preceded by a 1 in FIGS. 1-4; preceded by a 2 in FIGS. 5-8; preceded by a 3 in FIGS. 9-10; preceded by a 3 in FIGS. 11-12; preceded by a 5 in FIGS. 13-14; and preceded by a 6 in FIGS. 15-16. Elements of different examples can be interchangeable with elements of other examples. The cable assembly is not limited to the examples shown in the Figures. Numerical adjectives such as "first" and "second," including with reference to the limbs, the cams, the cable segments, and the units of the adjustment assembly are used herein as identifiers to distinguish components in the Figures, and the numerical adjectives do not indicate order, location, or importance.

In the examples shown in the Figures, the compound bow 10 includes two cable assemblies 18, as described further below. The adjustment assembly 20 is adjusted to adjust the length of the cable assembly 18, which adjusts the timing of cams 42, 44 of the compound bow 10, as described further below. Specifically, twisting the second unit 24 and the second cable segment 28 relative to the first unit 22 adjusts the length of the second cable segment 28. With the lock 32 in the unlocked position, the second unit 24 can be rotated relative to the first unit 22 to twist the second cable segment 28 (and in the example shown in FIGS. 5-8, the first unit 222 can be rotated relative to the second unit 224 to twist the first cable segment 226). The first unit 22 and the second unit 24 may be rotated relative to each other to the desired position for desired length of the second cable segment 28 (and the first cable segment 226) to set the designed length of the cable assembly 18. The lock 32 is then moved to the locked position to lock 32 the position of the first unit 22 to the second unit 24.

The example shown in FIGS. 1-4 includes two cable assemblies 118 that include the same components as each other, and the common components are identified with common reference numerals. The example, shown in FIGS. 5-8 includes two cable assemblies 218 that include the same components as each other, and the common components are identified with common reference numerals. FIGS. 9-10, 11-12, 13-14, and 15-16 show individual adjustment assemblies (namely adjustment assemblies 320, 420, 520, 620, respectively) that can be used interchangeably with the adjustment assemblies 120 of the cable assemblies 118 in FIGS. 1-4. For the examples in FIGS. 1-4, 9-10, 11-12, 13-14, and 15-16, one cable assembly 18 extends from the first limb 14 to the second cam 44 and the other cable assembly 18 extends from the second limb 16 to the first cam 44. With the lock 32 in the unlocked position, the second cable segment 28 of the cable assembly 18 extending from the first limb 14 to the second cam 44 is twisted to adjust the timing of the second cam 44. With the lock 32 in the unlocked position, the second cable segment 128 of the cable assembly 118 extending from the second limb 16 to the first cam 42 is twisted to adjust the timing of the second cam 44. In the example shown in FIGS. 5-8, one cable assembly 218 extends from a cammed track 80 of the first cam 42 to a circular track 78 of the second cam 44 and the other cable assembly 218 extends from a cammed track 80 of the second cam 44 to a circular track 78 of the first cam 42. With the lock 32 in the unlocked position, the first cable segment 226 and/or the second cable segment 228 of the cable assembly 218 extending from the cammed track 80 of the first cam 42 to the circular track 78 of the second cam 44 is twisted to adjust the timing of the first cam 42. With the lock 32 in the unlocked position, the first cable segment 226 and/or the second cable segment 228 of the cable assembly 218 extending from the cammed track 80 of the second cam 44 to the circular track 78 of the first cam 42 is twisted to adjust the timing of the second cam 44.

As set forth above, the compound bow 10 includes a pair of limbs, namely a first limb 14 and a second limb 16. The limbs 14, 16 flex to store energy when a bow string 46 is pulled to a drawn position, and the limbs 14, 16 deliver the energy to an arrow nocked on the bow string 46 when the bow string 46 is released. In the example shown in the Figures, merely as an example, the compound bow 10 is a vertical bow 10 and with the first limb 14 and a first cam 42 on the top of the compound bow 10 and with the second limb 16 and a second cam 44 on the bottom of the compound bow 10. The limbs 14, 16 may be split limbs 14, 16, as shown in the example in the Figures, and in other examples may be solid limbs 14, 16 or any other suitable limb design. In the examples shown in the Figures, the limbs 14, 16 include axles 76 that rotatably support the respective cam 42, 44.

The limbs 14, 16 extend from opposing ends of the riser 12. The limbs 14, 16 are supported by the riser 12, i.e., the weight of the limb is borne by the riser 12 when a user holds the riser 12. At least one cable assembly 18 extends between the limbs 14, 16 and the bow string 46 extends between the limbs 14, 16. For example, two cable assemblies 18 extend between the limbs 14, 16 in the example shown in the Figures. In other examples, the bow 10 may include additional cables and/or cable assemblies.

The compound bow 10 includes cams 42, 44 that are rotatably connected to the limbs 14, 16, namely the first cam 42 is rotatably connected to the first limb 14 and a second cam 44 is rotatably connected to the second limb 16. The cable assemblies 18 are connected to both limbs 14, 16, either directly, e.g., to the axle 76, or indirectly, e.g., to the cam 42, 44 on the limb 14, 16. As one example, each cable assembly 118 may be directly connected to one cam and one limb, as shown in the example of FIGS. 1-4, and, as another example, the cable assembly 218 may be directly connected to both cams 42, 44, as shown in the example of FIGS. 5-8. In the example shown in FIGS. 1-4, both second cable segments 128 are directly connected to a respective one of the limbs 14, 16, for example, by attachment to the axle 76 that connects the cam 42, 44 to the limb 14, 16.

The cam 42, 44 has at least one track engaged with the cable assembly 18 and/or a bow string 46 and at least one of the tracks is eccentric relative to the rotational axis of the cam 42, 44 on the axle 76. The cam 42, 44 in some examples may include the types that are currently known. The cams 42, 44 and can be of any suitable type. For example, the cams 42, 44 can be a single cam, hybrid cam, dual cam, binary cam, cam and a half, etc.

The bow string 46 extends between the limbs 14, 16. Specifically, the bow string 46 is directly connected to and extends between the cams 42, 44. By drawing the bow string 46 from a brace position to the drawn position, the bow string 46 rotates the cams 42, 44 to draw in the cable assembly 18 and resiliently flex the limbs 14, 16 toward each other. The bow string 46 may be of any suitable type and material including, in some examples, types and materials that are currently known.

With reference to FIG. 1, the riser 12 is elongated along a riser axis A. In operation, the riser axis A is generally vertical. "Bow-rearward" is a direction from the riser 12 toward the torso and head of the operator of the compound bow 10. "Bow-forward" is a direction from the riser 12 away from the torso and head of the operator, i.e., the direction opposite the bow-rearward direction. The compound bow 10 has a fore-and-aft axis B that extends bow 10-rearward and bow-forward through a front face and a rear face of the riser 12. The fore-and-aft axis B is perpendicular to the longitudinal axis A. "Lateral" is a direction perpendicular to the bow-rearward and bow-forward direction along an axis perpendicular to the longitudinal axis A. The compound bow 10 has a lateral axis C that extends laterally through a left face and a right face. The lateral axis C is perpendicular to the longitudinal axis A and the fore-and-aft axis B.

The riser 12 includes a handle 48. The handle 48 is gripped by the operator of the compound bow 10 to carry the compound bow 10 and to draw the compound bow 10 from the brace position to the drawn position. The handle 48 may be unitary with the rest of the riser 12. The handle 48 is elongated generally along the longitudinal axis A of the riser 12.

The riser 12 may include an arrow shelf, as shown in the example in the figures. The arrow shelf supports an arrow when an arrow is initially nocked to the bow string 46, i.e., the weight of the arrow is at least partly borne by the arrow shelf. The arrow may abut the arrow shelf when initially nocked to the bow string 46. The arrow shelf may support the arrow when the compound bow 10 is in the drawn position. The arrow shelf is above the handle 48.

Figure 2:
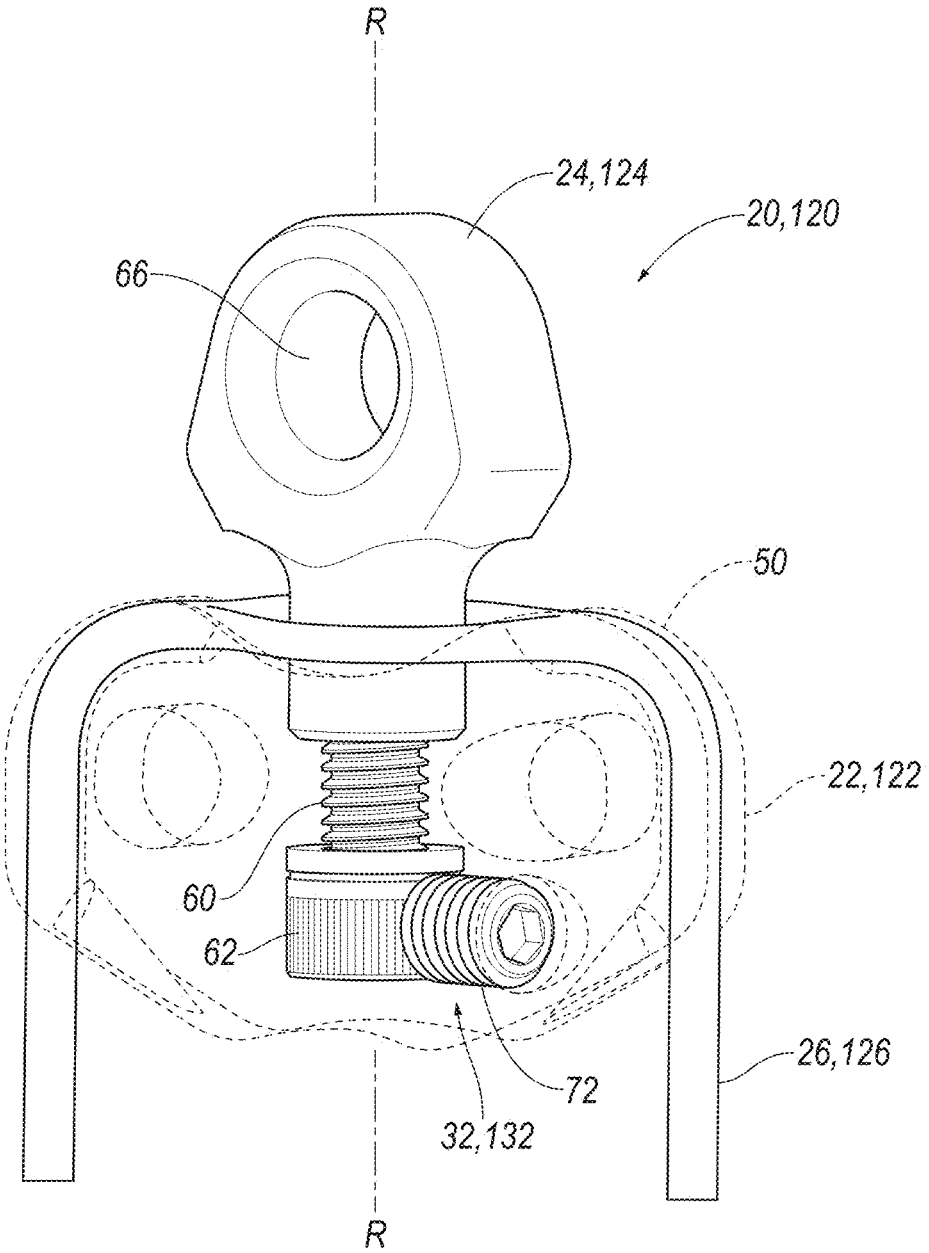
FIG. 2 is a perspective view of the adjustment assembly of FIG. 1.
Figure 3:
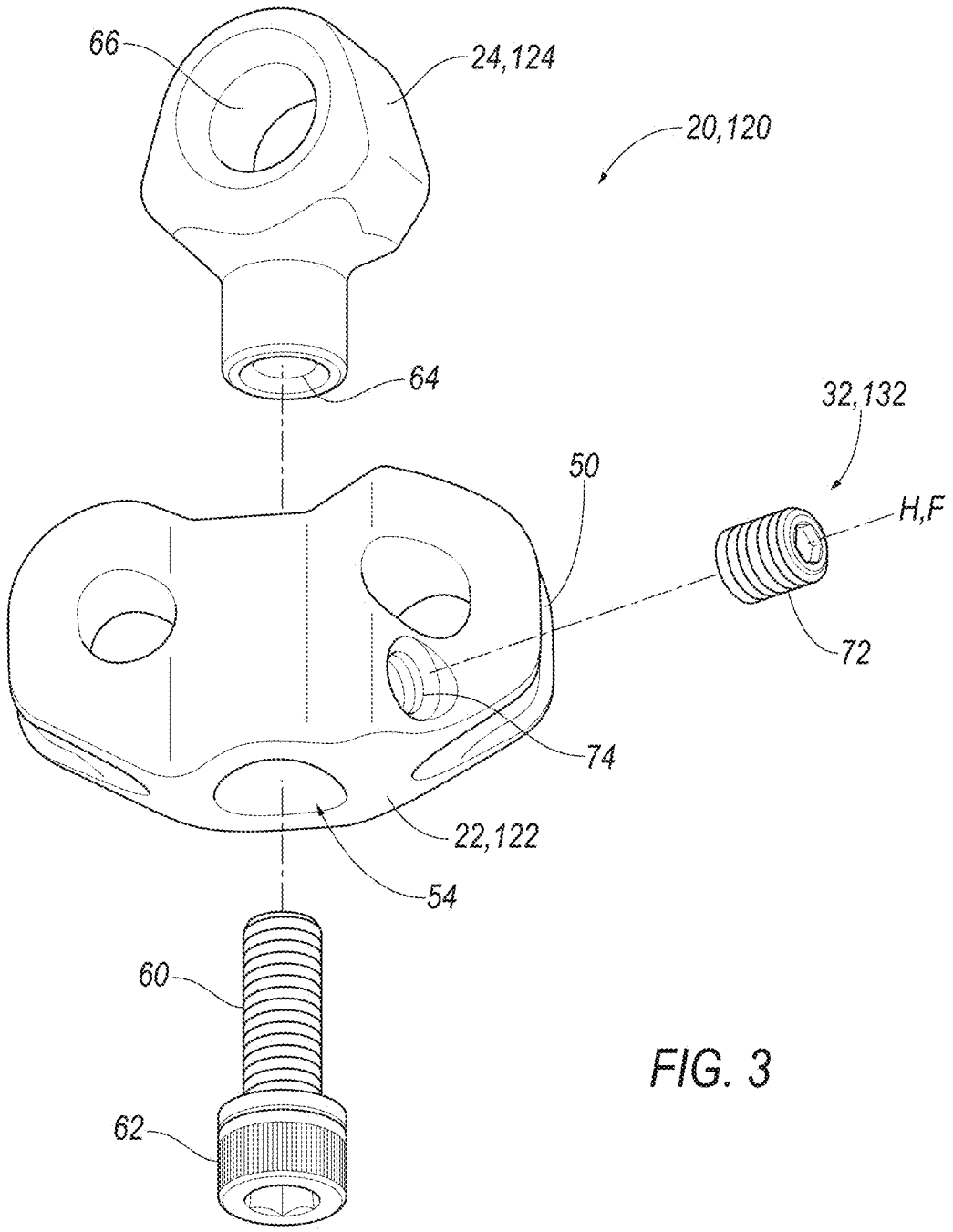
FIG. 3 is an exploded view of the adjustment assembly of FIG. 1.

With reference to FIGS. 1-3, the riser 12 may support components of the compound bow 10. For example, the riser 12 may support a quiver, a cable guide, a string suppressor, a sight, a drop-away arrow rest, etc.

The cable assembly 18 is between the first limb 14 and the second limb 16. When the bow string 46 is drawn to the drawn position, the bow string 46 rotates the cams 42, 44, which takes up the cable assembly 18. When the bow string 46 is released, the cams 42, 44 rotate to let out the cable assembly 18 and return to the brace position. As set forth above, the cable assembly 18 includes the adjustment assembly 20, the first cable segment 26, and the second cable segment 28. In the example in FIGS. 1-4, the first cable segment 126 extends from the adjustment assembly 120 to the limb 14, 16, e.g., an axle that supports the respective cam 42, 44 on the respective limb 14, 16. The second cable segment 128 extends from the adjustment assembly 120 to a respective one of the cams 42, 44, e.g., to a cammed track of the cam 42, 44. In the example shown in FIGS. 5-8, the first cable segment 226 extends from the adjustment assembly 220 to one of the cams 42, 44, e.g., a cammed track of the cam 42, 44, and the second cable 228 extends from the adjustment assembly 220 to the other of the cams 42, 44, e.g., a circular track of the cam 42, 44.

The cable assembly 18 has a longitudinal axis L. The cable assembly 18 is elongated along the longitudinal axis L, i.e., the longest dimension of the cable assembly 18 is along the longitudinal axis L. The cable assembly 18 connects the first limb 14 and the second limb 16 along the longitudinal axis L of the cable assembly 18. In the examples shown in the Figures, the cable assembly 18 extends from one limb to one cam or from one cam to the other cam, and the longitudinal axis L of the cable assembly 18 extends along the path of the cable assembly 18. The cable assembly 18 may engage a cable guide 52. In such an example, cable assembly 18 may curve at the cable guide 52, and in such examples, the axis L of the cable assembly 18 curves at the cable guide 52.

In some examples, including the examples shown in the Figures, the first cable segment 26 and the second cable segment 28 are discrete cables, i.e., are not separate areas of a unitary cable. In other words, in such examples, the cable segments each terminate at a terminal end at the first unit 22 or the second unit 24 of one of the adjustment assemblies 20, as described further below. Specifically, the first cable segment 26 has a terminal end 34 at the first unit 22 of the adjustment assembly 120. The second cable segment 28 has a terminal end 36 at the second unit 24 of the adjustment assembly 120, 220.

The cable segments 26, 28 may each include strands that are twisted or braided together axially along the cable segment, as is known. As described below, twisting the respective cable segment shortens or lengthens the respective cable. In other words, tightening the twist of the cable segment shortens the respective cable, and loosening the twist of the cable segment lengthens the respective cable. The cable segments 26, 28 may be of any suitable material for compound bow cables, including synthetic polymers such as polyethylene (e.g., commercially available under the name Dyneema).

In some examples, the cable segments, i.e., the first cable segment 126 in the example shown in FIGS. 1-4, that extend from first unit 122 of the adjustment assembly 120 to the respective limb may have two tails extending from the adjustment assembly 120 to the limb. The first cable segment 126 in such an example may be referred to as a split cable design. In such an example, the cable assembly 18 may be referred to as a split-yoke cable and the adjustment assembly 120 may be referred to as a yoke. In such an example, the ends of the first cable segment 126 may extend to opposite sides of the cam, i.e., a left side and a right side, and may engage the split limbs, e.g., at axle 76. In such an example, the first cable segment 126 extends around the first unit 122 and engages the first unit 122, e.g., in grooves 50. Strands of the first cable segment 126 may split around the first unit 122, as shown in FIG. 2. In such examples, the section of the first cable segment 126 that engages the grooves 50 is the terminal end 34 and two tails of the first cable segment 126 extend from the terminal end 34 on opposite sides of the respective cam 42, 44 to the respective limb 14, 16. In other examples, the first cable segment 226 may have one end extending from the adjustment assembly 220 to the respective cam 42, 44, as shown in the example in FIGS. 5-8. In such an example, the first cable segment 226 may engage a track, e.g., a circular track 78, on the respective cam 42, 44 such that the cable segment 226 is taken up or let out as the cam 42, 44 rotates.

As set forth above, in the examples shown in the Figures, the cable segments each terminate at a terminal end at the first unit 22 or the second unit 24. As one example, as shown in the example in FIGS. 1-4, the first cable segment 126 may be split around the adjustment assembly 120 at the terminal end 34. In such an example, the adjustment assembly 120, specifically the first unit 122 of the adjustment assembly 120, is embedded between strands of the first cable segment 126. In the example shown in FIGS. 1-4, the terminal end 36 of the second cable segment 28 at the second unit 124 of the adjustment assembly 120 is a knot, e.g., a Girth Hitch knot. As another example, as shown in the example in FIGS. 5-8, the terminal end 34 of the first cable segment 226 at the first unit 222 of the adjustment assembly 220 is a knot, e.g., a Girth Hitch knot. In the example in FIGS. 5-8, the terminal end 36 of the second cable segment 28 at the second unit 224 of the adjustment assembly 220 is a knot, e.g., a Girth Hitch knot.

The adjustment assembly 20 has a rotational axis R that extends through the first unit 22 and the second unit 24. The first unit 22 and the second unit 24 are rotatable relative to each other about the rotational axis R. The first unit 22 and the second unit 24 are rotatably engaged with each other when the lock 32 is in the unlocked position. In other words, when the lock 32 is in the unlocked position, the first unit 22 and the second unit 24 are retained together axially along the rotational axis R and are rotatable relative to each other about the rotational axis R. In some examples, including the examples shown in the Figures, the rotational axis R of the adjustment assembly 20 and the longitudinal axis of the cable assembly 18 are colinear.

In the example shown in FIGS. 1-4 the example shown in FIGS. 5-8, the example shown in FIGS. 9-10, and the example shown in FIGS. 13-14, the first unit 22 defines a first bore 54 and a second bore 56 that are coaxial with each other. The first bore 54 has a larger diameter than the second bore 56. The first unit 22 has a ledge 58 between the first bore 54 and the second bore 56. The second unit 24 includes a shaft 60 that extends through the second bore 56 to the first bore 54. The second unit 24 includes a head 62 fixed to the shaft 60 in the first bore 54. In such examples, the second unit 24 may include a threaded fastener including the shaft 60, which is threaded, and the head 62, and the second unit 24 may include a threaded hole 64 that threadedly receives the shaft 60 of the threaded fastener. In such an example, the threaded fastener may be locked in the threaded hole, e.g., with a polymeric thread locking material, to retain the threaded fastener in position in the threaded hole 64. The outer diameter of the head 62 is smaller than the diameter of the first bore 54 so that the head 62 is rotatable relative to the second unit 124, 224 about the rotational axis R when the lock 32 is unlocked. The head 62 may have a splined or knurled surface for engaging the lock 32, as described further below.

With reference to the examples in the Figures, the second unit 124, 224 defines an eyelet 66 to which the terminal end 36 of the second cable segment 128, 228 is fixed. In the example in FIGS. 1-4, the first unit 122 defines grooves 50 to which the terminal end 34 of the first cable segment 126 is fixed at a split in the first cable segment 126. In the example shown in FIGS. 5-8, the first unit 222 defines coaxial holes 68 spaced at the first bore 54. The terminal end 34 of the first cable segment 226 is fixed to a dowel pin 70 fixed in the coaxial holes 68. As an example, the first cable segment 226 may have a knot tied to the dowel pin 70 at the terminal end 34 of the first cable segment 126.

In the examples shown in the Figures, the terminal ends 34, 36 of the cable segments are fixed to the respective adjustment assemblies 20. In other words, the terminal end 34 moves as a unit with the first unit 22 and the terminal end 36 move as a unit with the second unit 24. Specifically, the terminal end 34 is rotationally fixed to the first unit 22, i.e., rotates with the first unit 22 as a unit with the first unit 22, and the terminal end 34 is axially fixed to the first unit 22, i.e., the terminal end 34 moves axially with the first unit 22 as a unit when the cable assembly 18 is in tension between the limbs 14, 16. The terminal end 36 is rotationally fixed to the second unit 24, i.e., rotates with the second unit 24 as a unit with the second unit 24, and the terminal end 36 is axially fixed to the second unit 24, i.e., the terminal end 36 moves axially with the second unit 24 as a unit when the cable assembly 18 is in tension between the limbs 14, 16. In the examples shown in the Figures, the terminal end 34 of the first cable segment 26 is fixed to the first unit 22 of the adjustment assembly 20, i.e., the terminal end 34 moves as a unit with the first unit 22 of the adjustment assembly 20 when the first unit 22 is rotated about the rotational axis R relative to the second unit 24. The terminal end 36 of the second cable segment 28 is fixed to the second unit 24 of the adjustment assembly 20, i.e., the terminal end 36 moves as a unit with the second unit 24 of the adjustment assembly 20 when the second unit 24 is rotated about the rotational axis R relative to the first unit 22. In the example shown in FIGS. 5-8, the second cable segment 228 may be shortened or lengthened by twisting.

The lock 32 is between the first unit 22 and the second unit 24. The lock 32 is movable between a locked position and an unlocked position. The first unit 22 and the second unit 24 are rotatable relative to each other about the rotational axis R of the adjustment assembly 20 when the lock 32 is in the unlocked position. The first unit 22 and the second unit 24 are fixed relative to each other about the rotational axis R of the adjustment assembly 20 when the lock 32 is in the locked position.

The adjustment assembly 20 is adjusted to adjust the length of the second cable segment 28 (and/or the first cable segment 226 in the example in FIGS. 5-8) along the longitudinal axis L, which adjusts the timing of the cams 42, 44. In other words, the length of the second cable segment 128 in FIGS. 1-4 can be lengthened or shortened to adjust the timing of the cam 42, 44 to which the second cable segment 128 is connected. The length of the first cable segment 226 and/or the length of the second cable segment 228 in the example in FIGS. 5-8 may be adjusted to adjust the timing of the cam 42, 44 to which the second segment 228 is connected.

The lock 32 is moved to the unlocked position, which allows for the first unit 22 to be rotated relative to the second unit 24 to twist at least one of the cable segments. In the examples shown in the Figures, the lock 32 of the adjustment assembly 20 is unlocked to allow for rotation of the second unit 24 relative to the first unit 22 to adjust the length of the second cable segment 28 along the longitudinal axis L and, in the example shown in FIGS. 5-8, to also allow for rotation of the first unit 222 relative to the second unit 224 to adjust the length of the first cable segment 226 and/or the second cable segment 228 along the longitudinal axis L. When one of the cable segments 28, 226 is twisted, depending on the direction of rotation, the strands of that cable segment are tightened to shorten the length of the cable segment or loosened to lengthen the length of the cable segment. After relative rotation of the first unit 22 and the second unit 24 to the desired position for desired length of the cable assembly 18, the lock 32 is then moved to the locked position to lock 32 the position of the first unit 22 to the second unit 24.

In some examples, the lock 32 (i.e., the lock 132, 232, 632) includes a fastener 72 carried by the one of the first unit 22 or the second unit 24 and engageable with the other of the first unit 22 or the second unit 24 in the locked position. Again, as set forth above, the adjectives "first" and "second" are used herein, including in the claims, merely as identifiers to distinguish between two components of the adjustment assembly 20. In the example shown in the Figures, the fastener 72 is carried by the first unit 22 and is selectively engageable with the second unit 24. In other examples, the second unit 24, may carry the fastener 72 and the fastener 72 may be selectively engageable with the first unit 22.

Figure 4:
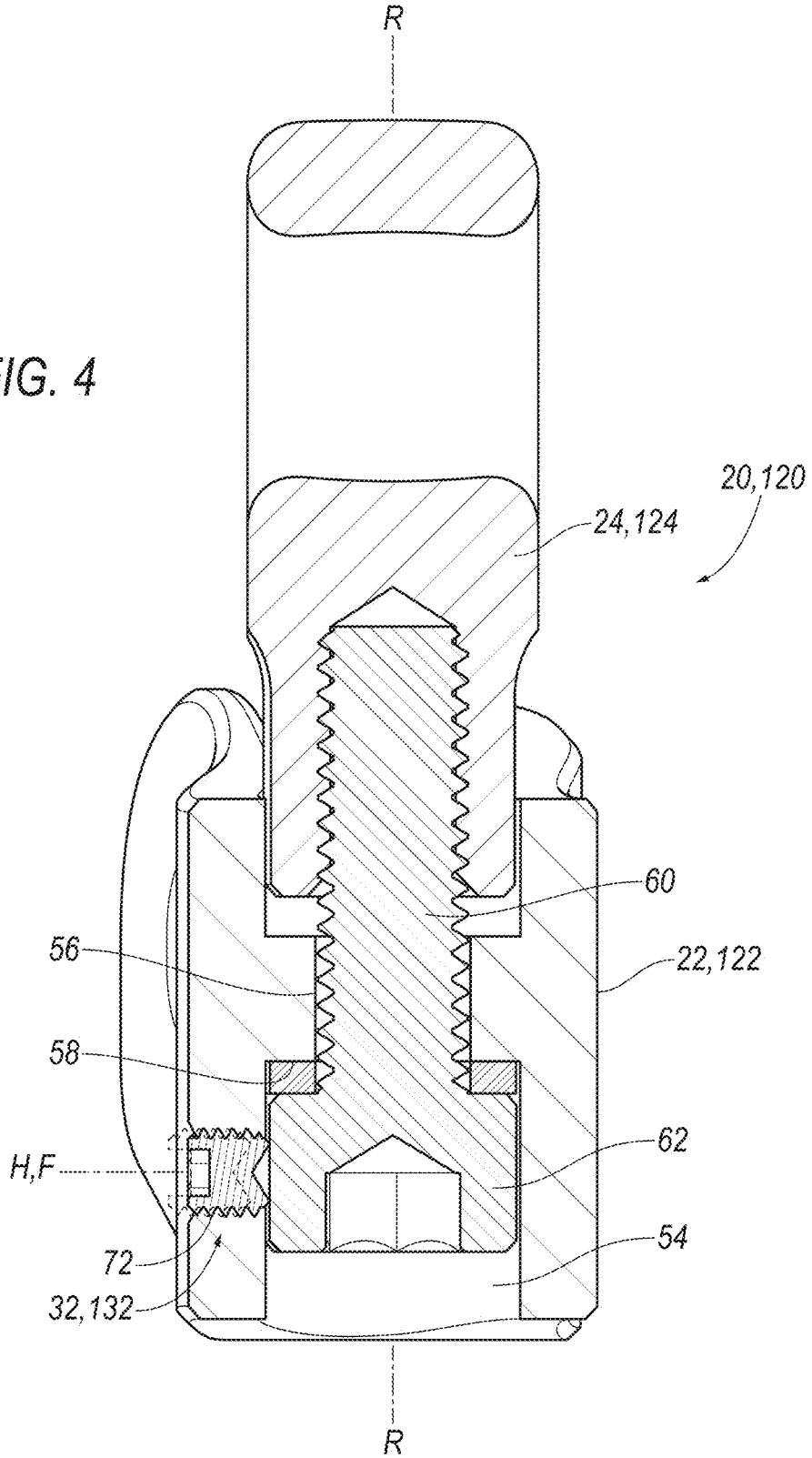
FIG. 4 is a cross-sectional view of the adjustment assembly of FIG. 1.
Figure 5:
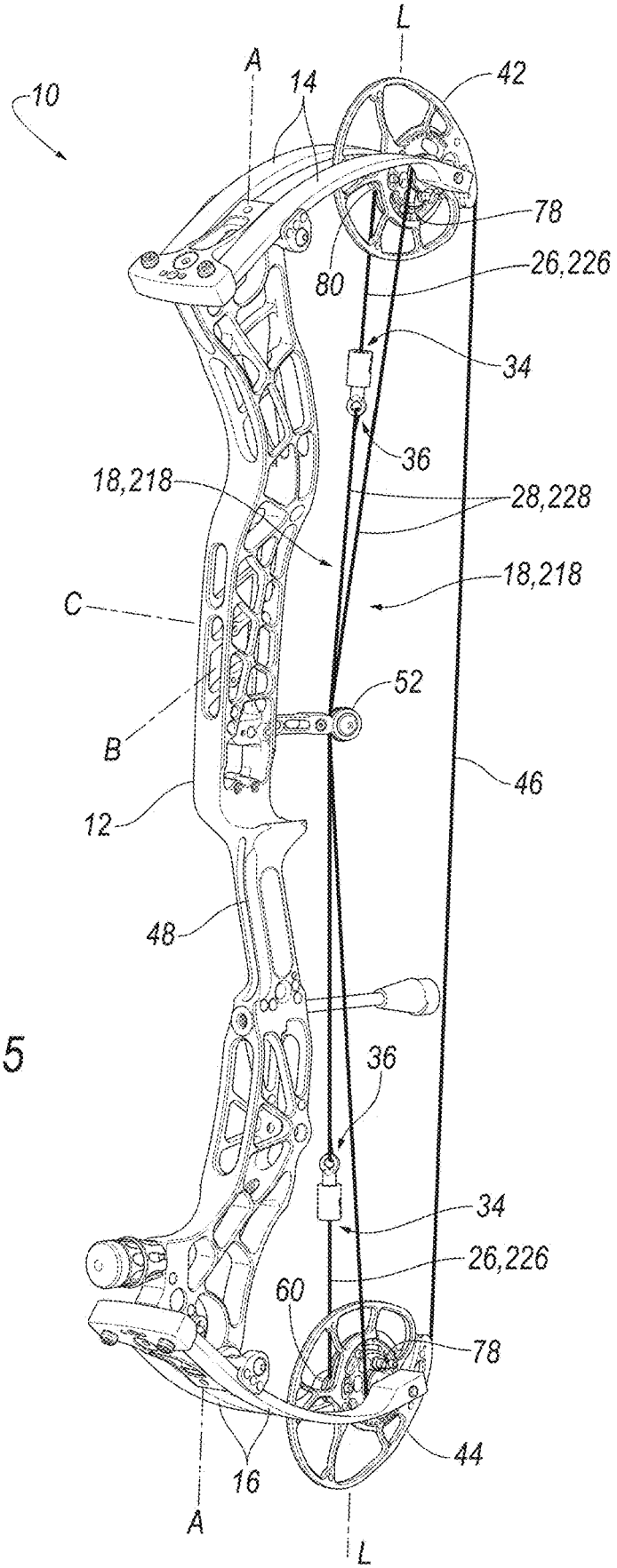
FIG. 5 is a perspective view of another example compound bow including two cables each including another example adjustment assembly.
Figure 6:
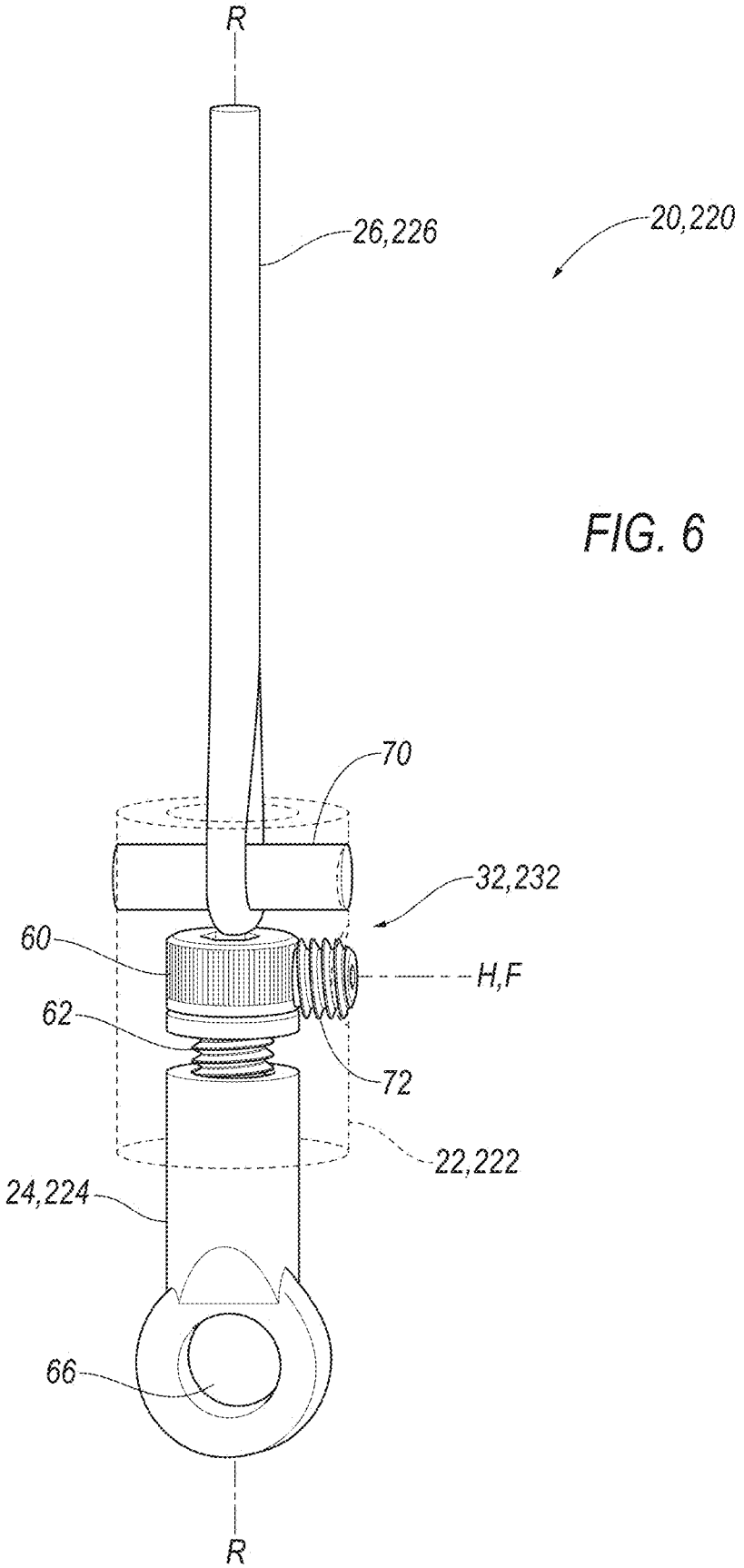
FIG. 6 is a perspective view of the adjustment assembly of FIG. 5.
Figure 7:
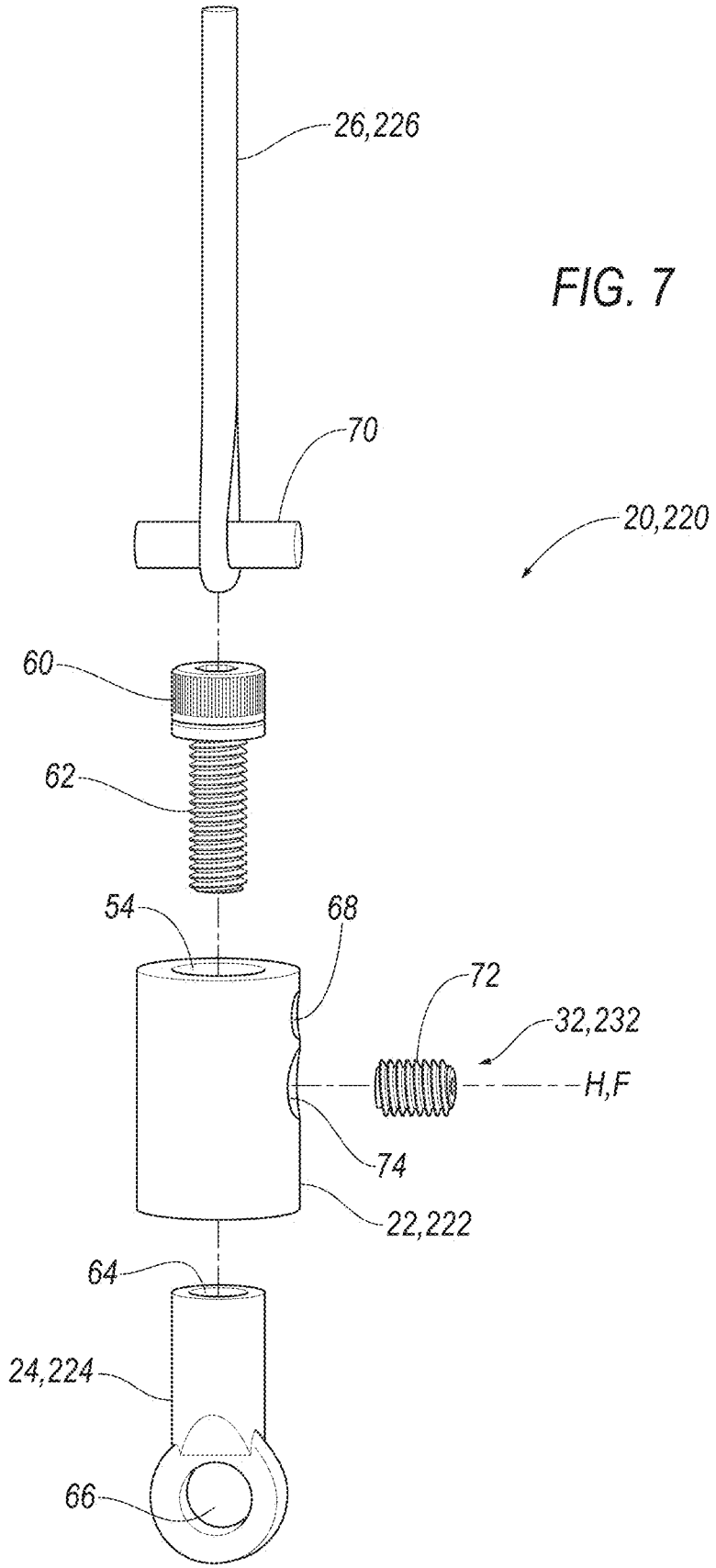
FIG. 7 is an exploded view of the adjustment assembly of FIG. 5.

In examples including the fastener 72, the fastener 72 is advanced to the locked position (shown in solid lines in FIGS. 4 and 8) and retreated to the unlocked position (as shown in broken lines in FIGS. 4 and 8). For example, in the examples shown in FIGS. 1-4, 5-8, and 15-16, the fastener 72 is carried by the first unit 22 and is moveable relative to the second unit 24 between the locked position and the unlocked position. In the locked position, the fastener 72 is engaged with the second unit 24 to prevent relative rotation between the first unit 22 and the second unit 24, and in the unlocked position, the fastener 72 is disengaged with the second unit 24 to allow relative rotation between the first unit 22 and the second unit 24 about the rotational axis R. In the examples shown in FIGS. 1-4, 5-8, and 15-16, the fastener 72 engages the second unit 24 by abutting the first unit 24.

In the examples shown in FIGS. 1-4, 5-8, and 15-16, the lock 32 (i.e., lock 132, lock 232, lock 632) includes a hole 74 in the first unit 22 and the fastener 72 is advanced in the hole 74 to the locked position and retreated from the hole 74 to the unlocked position. In the examples shown in FIGS. 1-4, 5-8, and 15-16, the hole 74 and the fastener 72 may be threaded such that the fastener 72 is advanced and retreated by rotation. In such examples, the fastener 72 may be a set screw.

The hole 74 has a hole axis H transverse to the second unit 24. The lock 32 is moveable along the hole axis H between the locked position and the unlocked position. For example, the fastener 72 has a fastener axis F colinear with the hole axis H, and the fastener 72 may be threadedly advanced and retracted along the hole axis H and fastener axis F between the locked and unlocked positions. In some examples, as shown in the examples in the Figures, the hole axis H and the fastener axis F may be transverse to the rotational axis R of the adjustment assembly 20, i.e., intersects the rotational axis R, so that the fastener 72 can be advanced toward the rotational axis R to the locked position and retreated away from the rotational axis R to the unlocked position. In the example shown in the Figures, the hole axis H and the fastener axis F are transverse to the head 62 so that the fastener 72 can be advanced into contact with the head 62 in the locked position and retracted to be spaced from the head 62 in the unlocked position. As set forth above, the head 62 may be knurled or splined to engage the fastener 72. The fastener 72 may have a point facing the head 62 to engage the head 62.

In the examples in FIGS. 9-10 and 11-12, the lock 32 (i.e., lock 323 and lock 432) includes a nut 82 that locks the second unit 324 to the first unit 322. Specifically, in the examples in FIGS. 9-10 and 11-12, the nut 82 is threadedly engaged with the shaft 60 of the second unit 324. The nut 82 is threadedly advanced along the rotational axis R by rotation of the nut 82 relative to the shaft 60. In the examples shown in FIGS. 9-10 and 11-12, the nut 82 is hexagonal. In other examples, the nut 82 may be of any suitable shape that can be threadedly advanced along the shaft 60 by hand or by tool.

In the example in FIGS. 9-10, in the unlocked position, the nut 82 is disengaged from the first unit 322, i.e., spaced from the first unit 324, to allow for rotation of the second unit 324 relative to the first unit 322 about the rotational axis R to twist the second cable segment 28. In the locked position, the nut 82 is advanced against the first unit 322, i.e., is in contact with the first unit 322, to prevent rotation of the second unit 324 relative to the first unit 322 about the rotational axis R. The nut 82 may be rotated from the unlocked position to the locked position by rotating the nut 82, e.g., by hand and/or a tool, toward the first unit 322 until the nut 82 is advanced against the first unit 322, and the nut 82 may be rotated from the locked position to the unlocked position by rotating the nut 82 away from the first unit 322 to space the nut 82 from the first unit 322.

In the example in FIGS. 9-10, the second unit 324 includes a shaft 60 that extends through the second bore 56 to the first bore 54 of the first unit 322. The first unit 322 has a ledge 58 between the first bore 54 and the second bore 56. The second unit 324 includes a head 62 fixed to the shaft 60 in the first bore 54 of the first unit 322. The outer diameter of the head 62 is smaller than the diameter of the first bore 54, i.e., at the ledge 58, so that the head 62 is rotatable relative to the second unit 324 about the rotational axis R when the lock 332 is unlocked. The first bore 54 and the second bore 56 in FIGS. 9-10 are not threaded, e.g., are smooth. The first unit 322 is between the nut 82 and the head 62, i.e., at the ledge 58. When the lock 332 is locked, i.e., the nut 82 is advanced against the first unit 322, the nut 82 compresses the first unit 322 between the nut 82 and the head 62, i.e., at the ledge 58, to lock the second unit 324 relative to the first unit 322, i.e., to prevent rotation of the second unit 324 relative to the first unit 322 about the rotational axis R.

In the example shown in FIGS. 11-12, the first unit 432 includes a threaded bore 84 and the second unit 432 includes a threaded shaft 460 that threadedly engages the threaded bore 84. The threaded shaft 460 is fixed relative to the segment of the second unit 432 that defines the eyelet 66, e.g., by unitary formation (e.g., molding, casting, forging, etc., as a single unit) or by fixed connection (e.g., adhesive, bonding, welding, polymeric thread locking material, etc. The threaded shaft 460 rotates as a unit with the eyelet 66.

The nut 82 in FIGS. 11-12 is threadedly engaged with the threaded shaft 460. In the unlocked position, the nut 82 is disengaged from the first unit 422, i.e., spaced from the first unit 422, to allow for rotation of the second unit 424 relative to the first unit 422 about the rotational axis R to twist the second cable segment 28. In the locked position, the nut 82 is jammed against the first unit 422, i.e., is in contact with the first unit 422, to prevent rotation of the second unit 424 relative to the first unit 422 about the rotational axis R.

In the example shown in FIGS. 11-12, the threaded shaft 460 extends through the threaded bore 84 and the first unit 422 is between the nut 82 and the eyelet 66. In other examples, the nut 82 may be on the threaded shaft 460 between the first unit 422 and the eyelet 66. In such examples, the threaded shaft 460 extends into the threaded bore 84 and may or may not extend through the threaded bore 84.

In some examples, the lock 32, e.g., lock 532, may include a clamp that clamps the first unit 22 to the second unit 24 to prevent rotation of the second unit 24 relative to the first unit 22 about the rotational axis R. In the example shown in FIGS. 13 and 14, for example, the first unit 522 includes a clamp 88 that clamps the second unit 524 to prevent rotation of the second unit 524 relative to the first unit 522 about the rotational axis R. The clamp 88 is shown in the locked position in FIG. 13 and in the unlocked position in FIG. 14.

In the example shown in FIGS. 13-14, the clamp 88 includes a slit 90 through the first unit 522 and a fastener 92 that opens and closes the slit 90 between the unlocked and locked positions. In the example shown in FIGS. 13-14, the slit 90 extends to the first bore 54 and the second bore 56. Specifically, the first unit 522 includes a hole 94 that extends across the slit 90, i.e., coaxially on one side of the slit 90 and the other side of the slit 90. As an example, the hole 94 may be threaded at least on the portion of the slit 90 opposite the head of the fastener 92. The fastener 92 is advanced across the slit 90 into the threaded engagement with the hole 94 to compress the slit 90, i.e., to move the sides of the first unit 522 opposing each other at the slit 90 toward each other.

In the locked position, the clamp 88 radially compresses the second unit 524 to prevent rotation of the second unit 524 relative to the first unit 522. For example, in the example shown in FIGS. 13-14, the second unit 524 includes a shaft 60 that extends through the second bore 56 to the first bore 54 of the first unit 522. The first unit 522 has a ledge 58 between the first bore 54 and the second bore 56. The second unit 524 includes a head 62 fixed to the shaft 60 in the first bore 54 of the first unit 522. The outer diameter of the head 62 is smaller than the diameter of the first bore 54, i.e., at the ledge 58, so that the head 62 is rotatable relative to the second unit 524 about the rotational axis R when the lock 532 is unlocked. The first bore 54 and the second bore 56 in FIGS. 9-10 are not threaded, e.g., are smooth. The slit 90 is designed to (i.e., sized, shaped, positioned) radially compress the first unit 522 against the shaft 60 and/or the head 62 at the first bore 54 and/or the second bore 56, respectively, to prevent rotation of the shaft 60 and/or the head 62. In the unlocked position, the slit 90 releases the compressive force of the first unit 522 against the shaft 60 and head 62 to allow the second unit 524 to rotate relative to the first unit 522.

In the example shown in FIGS. 13-14, the slit 90 may be open absent force by the fastener 92 to close the slit 90. In other words, the fastener 92 may be advanced into the first unit 522 to compressively close the slit 90, as shown in FIG.

13, and may be retracted from the first unit 522 to release the slit 90, as shown in FIG. 14, to unclamp the second unit 524. In other examples, the clamp may be of any suitably type, including a spring-loaded clamp, a lever-actuated clamp, etc. In some examples, the second unit 524 may include a straight shaft of generally constant diameter, i.e., without the head 62 (for example, see the example in FIGS. 15-16), and in such examples, the clamp may claim the straight shaft. In such examples, the straight shaft may be splined, knurled, etc., to aid in locking the first unit 522 and the second unit 524 when the clamp is in the locked position.

In the example shown in FIGS. 15-16, the second unit 624 includes a shaft 96 that is smooth and has a generally constant diameter and the first unit 622 includes a bore that is smooth and has a generally constant diameter. The shaft 96 extends through the first unit 622 in the bore and is slidable in the bore of the second unit 624. A retainer 98 retains the shaft 96 in the bore. The retainer 98, for example, may include a cap and a pin that engages a hole in the cap and a hole in the shaft 96, as shown in the examples in FIGS. 15-16. In the example in FIGS. 15-16, the lock 632 includes a hole 74 in the first unit 622 and the fastener 72 is advanced in the hole 74 to the locked position and retreated from the hole 74 to the unlocked position. Specifically, the hole 74 and the fastener 72 may be threaded such that the fastener 72 is advanced and retreated by rotation. The fastener 72 abuts the shaft 96 in the bore to prevent rotation of the first unit 622 relative to the second unit 624 in the locked position, and the fastener 72 is spaced from the shaft 96 to allow rotation of the first unit 622 relative to the second unit 624 in the unlocked position. In such examples, the fastener 72 may be a set screw. In the example shown in FIGS. 15-16, the shaft 96 is smooth. In other examples, the shaft may be splined, knurled, etc.

The first unit 22 and the second unit 24 may include indicia for identifying the rotational position of the first unit 22 and the second unit 24 relative to each other, which can be used to identify the amount of twist applied to the second cable segment 28 (and the first cable segment 126 in the example shown in FIGS. 5-8) when the first unit 22 is rotated relative to the second unit 24 when the lock 32 is in the unlocked position. In the example shown in FIGS. 15-16, the indicia include an arrow on the first unit 22 and ticks on the cap of the retainer 98. As the second unit 624 is rotated relative to the first unit 622, i.e., when the lock 32 is in the unlocked position, the cap rotates as a unit with the second unit 624, i.e., through the connection of the pin with the cap and the second unit 624. In such an example, the movement of the ticks relative to the arrow can be used to identify the twist being applied to the second cable segment 28 fixed to the eyelet 66 of the second unit 624.

The disclosure has been described in an illustrative manner, and it is to be understood that the terminology which has been used is intended to be in the nature of words of description rather than of limitation. Many modifications and variations of the present disclosure are possible in light of the above teachings, and the disclosure may be practiced otherwise than as specifically described.

What is claimed is:

1. A compound bow comprising:

a riser;

a first limb and a second limb each supported by the riser; and a cable assembly connecting the first limb and the second limb along a longitudinal axis of the cable assembly;

the cable assembly including an adjustment assembly having a first unit and a second unit;

the cable assembly including a first cable segment extending from the first unit toward the first limb, a terminal end of the first cable segment being fixed to the first unit;

the cable assembly including a second cable segment extending from the second unit toward the second limb, a terminal end of the second cable being fixed to the second unit;

the adjustment assembly including a lock between the first unit and the second unit, the lock being movable between a locked position and an unlocked position;

the first unit and the second unit being rotatable relative to each other about a rotational axis when the lock is in the unlocked position, the terminal end of the second cable segment remaining axially stationary along the rotational axis relative to the terminal end of the first cable segment during relative rotation; and the first unit and the second unit being fixed relative to each other when the lock is in the locked position.

2. The compound bow as set forth in claim 1, wherein the lock is a fastener engaged with the first unit, the fastener being moveable relative to the first unit between the locked position and the unlocked position, the fastener being fixed to the first unit and the second unit in the locked position and being disengaged with the second unit in the unlocked position.

3. The compound bow as set forth in claim 2, wherein the first unit includes a fastener hole, the fastener hole having a hole axis transverse to an axis of the second unit, the fastener being in the fastener hole and movable along the hole axis between the locked position and the unlocked position.

4. The compound bow as set forth in claim 3, wherein the fastener hole and the fastener are threaded.

5. The compound bow as set forth in claim 1, wherein:

the first unit includes a fastener hole that is threaded, the fastener hole having a hole axis transverse to an axis of the second unit;

the lock is a fastener that is threadedly engaged with the fastener hole; and the fastener is threadedly advanced along the hole axis toward the second unit from the unlocked position toward the locked position and is threadedly retreated along the hole axis away from the second unit from the locked position toward the unlocked position.

6. The compound bow as set forth in claim 5, wherein:

the first unit defines a hole coaxial with the axis of the second unit;

a portion of the second unit is retained in the hole of the first unit; and the fastener engages the portion of the second unit retained in the hole of the first unit in the locked position.

7. The compound bow as set forth in claim 1, wherein:

the first unit defines a hole coaxial with an axis of the second unit; and a portion of the second unit is retained in the hole of the first unit.

8. The compound bow as set forth in claim 1, wherein the second unit has a body on an axis of the second unit and a threaded fastener extending from the body along the axis of the second unit, the lock engaging the threaded fastener in the locked position and being disengaged with the threaded fastener in the unlocked position.

9. The compound bow of claim 8, wherein the body defines an eyelet fixed to the terminal end of the second cable segment.

10. The compound bow of claim 8, wherein the first unit defines a fastener hole that is threaded, and the lock is a threaded fastener that is threadedly advanced in the fastener hole toward the second unit from the unlocked position toward the locked position and away from the second unit from the locked position toward the unlocked position.

11. The compound bow of claim 1, wherein the second unit is rotationally fixed to the first unit when the lock is in the locked position.

12. The compound bow of claim 1, wherein the lock is engaged with the first unit in the unlocked position.

13. The compound bow as set forth in claim 1, wherein rotation of the second unit about the rotational axis relative to the first unit adjusts the length of the second cable segment.

14. The compound bow as set forth in claim 1, further comprising a first cam rotatably connected to the first limb and a second cam rotatably connected to the second limb, the cable assembly being fixed to the first cam and the second cam.

15. A cable assembly for a compound bow, the cable assembly comprising:

an adjustment assembly having a first unit and a second unit;

a first cable segment having a terminal end fixed to the first unit;

a second cable segment having a terminal end fixed to the second unit; and a lock between the first unit and the second unit, the lock being movable between a locked position and an unlocked position;

the first unit and the second unit being rotatable relative to each other about a rotational axis when the lock is in the unlocked position, the terminal end of the second cable remaining axially stationary along the rotational axis relative to the terminal end of the first cable segment during relative rotation; and the first unit and the second unit being fixed relative to each other when the lock is in the locked position.

16. The compound bow as set forth in claim 15, wherein:

the first unit defines a hole coaxial with an axis of the second unit; and a portion of the second unit is retained in the hole of the first unit.

17. The cable assembly as set forth in claim 15, wherein the second unit has a body on an axis of the second unit and a threaded fastener extending from the body along the axis, the lock engaging the threaded fastener in the locked position and being disengaged with the threaded fastener in the unlocked position.

18. The cable assembly of claim 17, wherein the body defines an eyelet fixed to the terminal end of the second cable.

19. A cable-adjustment assembly for a compound bow, the cable-adjustment assembly comprising:

a first unit configured to be rotationally fixed to a first cable segment;

a second unit configured to be rotationally fixed to a second cable segment; and a lock between the first unit and the second unit, the lock being movable between a locked position and an unlocked position;

the first unit and the second unit being rotatable relative to each other about a rotational axis when the lock is in the unlocked position, the terminal end of the second cable remaining axially stationary along the rotational axis relative to the terminal end of the first cable segment during relative rotation; and the first unit and the second unit being fixed relative to each other when the lock is in the locked position.

20. The cable-adjustment assembly as set forth in claim 19, wherein the second unit has a body on the axis of the second unit and a threaded fastener extending from the body along the axis, the lock engaging the threaded fastener in the locked position and being disengaged with the threaded fastener in the unlocked position.

* * * * *